United States Patent [19]

Anokhin

[11] 4,388,390

[45] Jun. 14, 1983

[54] ELECTROPHOTOGRAPHIC METHOD FOR PRODUCING AN IMAGE ON DIELECTRIC FILM USING ION GENERATION

[76] Inventor: Felix A. Anokhin, ulitsa Argunovskaya, 8, kv. 222, Moscow, U.S.S.R.

[21] Appl. No.: 354,091

[22] PCT Filed: May 30, 1980

[86] PCT No.: PCT/SU80/00097

§ 371 Date: Jan. 26, 1982

§ 102(e) Date: Jan. 26, 1982

[87] PCT Pub. No.: WO81/03556

PCT Pub. Date: Dec. 10, 1981

[51] Int. Cl.[3] ..... G03G 13/18

[52] U.S. Cl. ..... 430/48; 430/53; 430/55; 430/97; 355/3 TE

[58] Field of Search ..... 430/48, 97, 53; 355/3 TE

[56] References Cited

U.S. PATENT DOCUMENTS 2,937,943 5/1960 Walkup ..... 96/1

3,545,969 12/1970 Herrick et al. ..... 430/48

FOREIGN PATENT DOCUMENTS 572751 9/1977 U.S.S.R. .

*Primary Examiner*—John D. Welsh

*Attorney, Agent, or Firm*—Steinberg & Raskin

[57] ABSTRACT

An electrophotographic method, in which a dielectric film is contacted with a surface of a charged and exposed electrophotographic layer and said film is acted on by positive and negative ions of the same concentration from a source of ions, which settle on the film and produce a latent image thereon. Then the electrophotographic layer is illuminated by an actinic light source to preserve the latent image on the film and the film is separated from the electrophotographic layer while being illuminated or after that. Thereafter the latent image obtained on the film is developed and fixed.

5 Claims, 9 Drawing Figures

ELECTROPHOTOGRAPHIC METHOD FOR PRODUCING AN IMAGE ON DIELECTRIC FILM USING ION GENERATION

TECHNICAL FIELD

The present invention relates to the field of producing of visible images by means of an electrophotographic method using electrostatic charged images. More particularly, the invention relates to methods of obtaining a picture on a dielectric film.

BACKGROUND OF THE INVENTION

The known electrophotographic methods for obtaining a picture on films are based on transfer of a latent image from a charged and exposed selenium layer onto a dielectric film by producing a gas discharge in the air gap between the selenium layer and the dielectric film (U.S. Pat. No. 2,937,943, published on May 24, 1960).

This method has insufficient resolution. The picture thus obtained is blurred due to scattering of ions in the gas-discharge gap.

Furthermore, when developing the wide fields on the transferred latent image a marginal effect is observed, as well as on the exposed selenium layer. The value of the charge of the transferred image is different for the image elements of different width. Therefore, during the development the optical density of the image elements is different.

Known in the art is a charge-free method for obtaining an image on a dielectric film, in which the dielectric film is brought in contact with surface of a charged and exposed electrophotographic layer, then the field of the latent image is developed and fixed (cf. R. Shaffert "Electrophotography", "Mir" publishers, Moscow, 1968, p.p. 323–333).

In this discharge-free method the image is sharper than in the above-mentioned method, however, it is still inadequate for practical purposes. This is associated with a decrease in the gradient of the field intensity at the boundaries of the fine lines on the film surface to the refraction of the field line in the film.

Like in the methods based on a gas discharge, the discharge-free method does not suitable for producing an image with wide fields without fringe effect. Furthermore, the optical density of the image elements of different width is also not constant.

All this hinders utilization of the images obtained for making copies on the light-sensitive layer of an offset plate. Furthermore, the above described method does not allow one to obtain several images using a once-exposed electrophotographic layer.

DISCLOSURE OF THE INVENTION

The main object of the invention is to develop an electrophotographic method for producing an image on a dielectric film, in which production of a latent image on the film, which is a bipolar system of charges located in the same plane, would make it possible to improve the sharpness of the edge of the fine lines of the image and to eliminate the fringe effect.

This object is attained by providing an electrophotographic method for producing an image on a dielectric film, in which the dielectric film is contacted with the surface of a charged and exposed electrophotographic layer, the image produced on the film being developed and fixed; according to the invention, after the dielectric film has been brought in contact with the electrophotographic layer, the dielectric film is acted on by positive and negative ions of the same concentration from an ion source; the ions settle on the film and produce a latent image thereon; prior to developing this image the electrophotographic layer is illuminated by an actinic light source.

During and after the illumination of the electrophotographic layer by the actinic light source, it is expedient to separate the dielectric film from the electrophotographic layer for eliminating the fringe effect during subsequent development of the once reproduced latent image.

The object of the invention is also attained due to the fact that in the electrophotographic method for producing an image on a dielectric film, in which the dielectric film is contacted with the surface of a charged and exposed electrophotographic layer; the latent image is developed and fixed; according to the invention, after the dielectric film has been brought in contact with the electrophotographic layer, the dielectric film is acted on by positive and negative ions of the same concentration from a source of ions, which settle on the film and produce a latent image thereon; after that the dielectric film is separated from the electrophotographic layer illuminated by a non-actinic light source to eliminate the fringe effect during the subsequent development of the multiple-reproduced latent image.

The charge of the latent image on the dielectric film is preferably increased by raising the potential of the charge of the electrophotographic layer, in which case the dielectric film is separated from the electrophotographic layer in an electrically inert medium preventing a discharge between this film and the electrophotographic layer.

It is expedient to use the chlorine derivatives or fluochloroderivatives of hydrocarbons of the aliphatic group as an electrically inert medium.

The electrophotographic method of producing an image on a dielectric film makes it possible to improve the quality of the image, i.e. to increase the sharpness of the edges and the resolution when developing the latent electrophotographic image on dielectric films of up to 100 μm thick. The method makes it possible to completely eliminate the fringe effect when reproducing images containing continuous sections of any size and to obtain a few images on the films after reproducing the original only once.

Furthermore, the method increases the optical density and contrast of the image on diapositives while providing uniform reproduction of continuous fields.

BRIEF DESCRIPTION OF THE DRAWINGS

The invention is further described by way of example with reference to the accompanying drawings, in which.

BEST MODE FOR CARRYING OUT THE INVENTION

The electrophotographic method for producing an image on a dielectric film is effected as follows.

Figure 1:
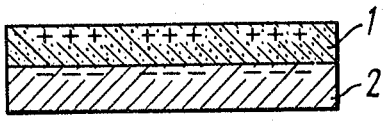
FIG. 1 shows a selenium layer on a metal substrate carrying a positively charged latent electrostatic image.
Figure 2:
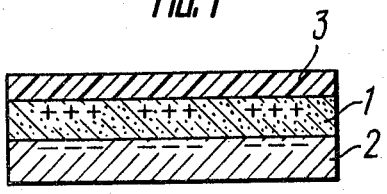
FIG. 2 is the same as in FIG. 1 with a dielectric film on a selenium layer.
Figure 3:
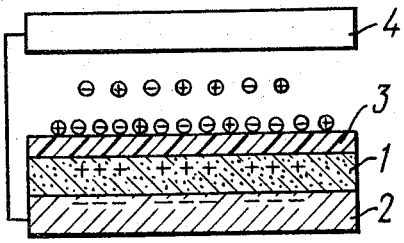
FIG. 3 is the same as in FIG. 2, with a source of ions settling on the dielectric film in accordance with the operation of compensation of the field of charges of the latent image on the selenium layer, according to the invention.

A dielectric film 3 (FIG. 2) is applied on a charged and exposed electrophotographic layer, in this embodiment—a selenium layer 1 (FIG. 1) applied on a metallic substrate 2. The dielectric film is applied on the selenium layer in a vacuum chamber and is brought in contact with the entire surface of this selenium layer 1. After that, the dielectric film 3 is acted on by positive and negative ions of the same concentration from an ion source 4 (FIG. 3), which is located above the film 3. Used as a source 4 are well known static eliminators of the radioisotope type or neutralizers with a corona or slide discharge. In the latter case the identical concentration of ions of different polarity in the space between the film 3 and the outlet of the source 4 is provided by properly selecting the supply current.

When the film 3 is acted on by ions of different polarity, these ions settle on the film 3 and the portions of the film 3 located, for example, above the positively charged latent image on the selenium layer 1 acquire a negative charge, while the portions located above the blank elements of the latent image acquire a positive charge. In other words, the action of the ions of different polarity results in complete neutralization of the field of the latent image above the film 3 and in production of a latent image on the film 3 itself.

After the film 3 has been acted on by the flow of ions, the ion source 4 is removed. In order to obtain an electrical field of charges on the latent image above the film 3, the selenium layer 1 is illuminated by an actinic light source 5 (FIG. 4), e.g. by an ordinary incandescent lamp or by a fluorescent lamp. In so doing, the latent image on the selenium layer 1 (FIG. 5) is destroyed while on the film 3 the image on the film 3 remains intact.

Figure 6:
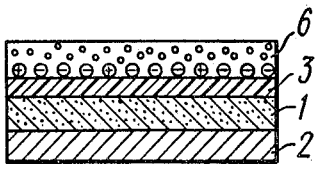
FIG. 6 is the same as in FIG. 5, with a layer of a developing composition on the dielectric film, according to the invention.

After illuminating the latent image on the selenium layer 1, the obtained latent image on the dielectric film 3 is developed. For this purpose, a developer 6 (FIG. 6) is applied onto the surface of the film 3. In the proposed method any known developer can be used, i.e. liquid, dry or aerosol. Liquid developers are preferable, since they provide an image of higher quality than all other compositions.

Figure 7:
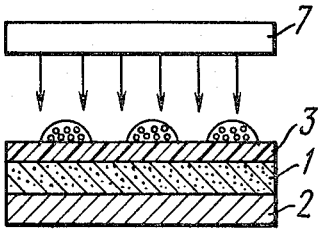
FIG. 7 shows a dielectric film with a developed image located on the selenium layer and a device for fixing the image, according to the invention.
Figure 8:
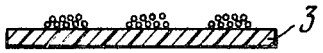
FIG. 8 shows a film with an image obtained, according to the invention.

After removing the residues of the developer 6 from the surface of the film 3, the developed image is fixed depending on the type of the developer 6 through a device 7 (FIG. 7) for fixing the image. After the fixing the film 3 (FIG. 8) is a finished diapositive.

The latent image produced on the film is featured by high gradient of intensities in the boundary regions of the charges and this makes it possible to improve edge contrast and, therefore, the resolution of the method in general. Furthermore, the presence of charges of a latent image on the film makes it possible to remove the film from the selenium layer after the process of development without waiting until the image is fixed. This allows one, for example, to conduct thermal fixing of powdery imagess without contacting the film to the layer.

Figure 4:
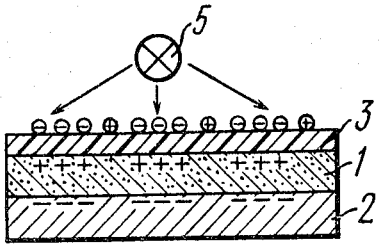
FIG. 4 shows a dielectric film with ions settled thereon, said film being located on a selenium layer illuminated by an actinic light source in accordance with the operation of destruction of the latent image on the selenium layer, according to the invention.
Figure 5:
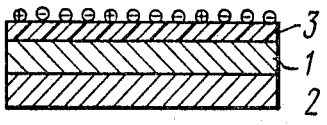
FIG. 5 shows a dielectric film located on the selenium layer after destroying the latent image on this layer, according to the invention.
Figure 9:
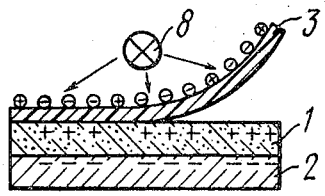
FIG. 9 shows a dielectric film with ions settled thereon, said film being separated from the selenium layer when illuminated by a non-actinic light source in accordance with the operation of separation, according to the invention.

When the proposed method is used for obtaining images having wide continuous fields, the dielectric film 3 is removed from the selenium layer 1 (FIG. 9) during or after the illumination of the selenium layer 1 by an active light source 5 (FIG. 4). Then a suitable developer is applied onto the surface of the film 3 and the latent image is developed and fixed. These operations are effected as described above.

The separation of the film results in an increase in the potential of the latent image charge. Furthermore, the field intensity above the middle and edges of a continuous field becomes the same. This allows one to reproduce continuous fields with uniform density after the development.

Thus, the separation of the film during the illumination of the selenium layer makes it possible to obtain a once reproduce latent image without a fringe effect.

In order to eliminate the fringe effect when reproducing the image containing continuous fields of any size and to obtain a few images on the films after one reproduction of the original, the film 3 (FIG. 4) is acted on by bipolar ions thus completely compensating the field of the latent image and by subsequently separating the film 3 (FIG. 9) with the latent image from the selenium layer 1 using a non-actinic light source 8. When the film 3 is separated from the layer 1, the field intensity above the medium portion and edges of the continuous section increases and becomes constant. This makes it possible the following development to reproduce continuous fields with uniform density regardless of their size. Since the film 3 is separated while being illuminated by a non-actinic light source, the latent image on the selenium layer 1 remains intact. This allows one to repeate the above described operation of obtaining an image until the potential of the selenium layer drops below permissible level due to dark discharge.

In order to increase the optical density and contrast of the image on diapositives with uniform reproduction of continuous fields, the charge of the latent image on the film 3 (FIG. 9) is intensified by increasing the charge potential of the charge of the selenium layer 1. In this case, like in the case of producing a once-reproduced latent image and in the case of producing a multiple-reproduced latent image, the separation of the film 3 is effected in an electrically inert medium preventing origination of discharges between the film 3 and the selenium layer 1. The chloride derivatives of hydrocarbons of the aliphatic series or fluorochlorine derivatives of hydrocarbons of the same series are used as an electrically inert medium.

Separation to the film in an inert medium makes it possible to increase the potential of the selenium layer to 1000 V and to increase the optical density D of the lines of the dispositive to 3.5 with a contrast coefficient $\gamma$ of up to 15.

For better understanding of the electrophotographic method for producing an image on a dielectric film specific embodiments of the invention are given hereinbelow by way of example.

EXAMPLE 1

A lined original—a positive with optical density of the image of 1.45 and that of the background of 0.2—is reproduced in a copying apparatus. A selenium plate with a layer 50 microns thick is charged with a positive charge in the processor of the apparatus to a potential of 600 V and then is exposed during 35 seconds with an aperture of 1:22. The exposed plate is transferred into a room with non-actinic lighting and placed into a vacuum chamber, where a sheet of triacetate film 25 microns this is laid into the selenium layer. After a complete contact of the film with the entire surface of the selenium layer has been achieved, a radioisotope static eliminator is placed above the selenium layer at a distance of 30 mm and kept therein during 5 to 10 seconds. After that the selenium layer is subjected to general illumination during 2 seconds by a 75-W incandescent lamp, which is located at a distance of 1 m from the selenium layer.

The image is developed by means of a dry electrophotographic developer using a magnetic brush. The film with a developed positive image is then removed from the selenium layer and the powder is thermally fixed by holding it in a thermostate. The blurriness of the obtained image is within 5–10 μm, while that of the image obtained by the known method it is equal to 50–75 μm.

EXAMPLE 2

The lined original is reproduced as described in Example 1 but the development is effected by means of a liquid electrophotographic developer for negatively charged images. The developer is fed into the space between the external surface of the film and a flat metal electrode located at a distance of 1 mm from the film. After the development the image is dried by an air stream. The blurriness of the obtained image is practically absent. The blurriness of the image obtained by the known method is 40 μm.

EXAMPLE 3

A diapositive image is produced from a negative original. The image is produced on a film by projecting the negative picture on a 50-μm layer by means of an enlarger. The selenium layer is charged with positive charges from a corona-arc discharger to a potential of 600 V. The exposure is made during 3 seconds with an aperture of 1:16 and an incandescent lamp 100 W. Then all subsequent operations are conducted, similar to those described in Examples 1 and 2, then the latent image is developed by a liquid developer for positively charged images. As a result, a diapositive is produced which practically has no blurriness.

Compared to the known methods, the use of the proposed electrophotographic method for producing an image described in Examples 1 to 3 provides much higher sharpness of the image, which is especially important in printing-plate processes of polygraphic industry; high reproducibility of the obtained results under any climatic conditions; high economy of the process due to an increase in the working capacity of the selenium layers.

EXAMPLE 4

A lined positive original having optical density of the image of 1.45 and that of the background of 0.15 is reproduced by means of a projector. The selenium layer 50 μm thick is charged positively to a potential of 100 V and then exposed during 60 seconds with an aperture of 1:22. The exposed plate is placed into a room with non-actinic light, where the selenium layer of the plate in a vacuum frame is covered by a sheet of triacetate film 25 μm thick. After the complete contact of the film with the entire surface of the selenium layer has been achieved, a radioisotope static eliminator is placed above the selenium layer at a distance of 30 mm for a period of 5–10 seconds, the body of the static eliminator being connected to the substrate of the selenium layer. Then the selenium layer is exposed to the light of an incandescent lamp 100–75 W during 1 to 2 sec. The distance between the lamp and selenium layer is equal to 1 m. The film with a latent image is separated from the selenium layer and external surface of the film is washed with a liquid electrophotographic developer for 5 to 10 seconds. As a result, a positive image of the original is produced having uniformly developed continuous sections.

EXAMPLE 5

A lined original is reproduced as described in Example 4, but the developer is applied to both sides of the film. As a result, direct and reverse images of the original are obtained on the two surfaces of the film.

EXAMPLE 6

A tone original with a range of optical densities from 0.05 to 1.95 is reproduced as described in Example 4 but with an exposure of 20–25 seconds. As a result, an image is produced with adequate tone transmission within a density interval from 0.05 to 1.3 and without a fringe effect on the image. The film is separated from the selenium layer during the exposure. If fogging appears, the housing of the static eliminator is insulated from the selenium layer substrate.

Compared to the known methods, the use of the proposed electrophotographic method of producing an image described in Examples 4 to 6 makes it possible to obtain diapositives featured by high sharpness of the image with uniform reproduction of continuous fields and high technological parameters of the process due to essential simplification of this process.

EXAMPLE 7

A lined positive original is reproduced as described in Example 4 but the film with a latent image is separated from the selenium layer at non-actinic illumination thus preserving the latent image on the selenium layer.

EXAMPLE 8

A positive lined original is reproduced as described in Example 7 but a static eliminator is used providing a sliding discharge. This eliminator is made by winding a wire coil around a piece of an insulated wire, an a-c voltage of 2 to 8 kV being applied to the wire and the coil connected to the selenium layer. The operating time of the static eliminator at a distance of 100 mm is equal to 1–2 sec. If fogging appears, the static eliminator body is insulated from the selenium layer.

EXAMPLE 9

The lined original is reproduced as described in Examples 7 and 8 but the developer is fed to both sides of the film by immersing the latter into a vertical metal cuvette. As a result, on both sides of the film there is produced a positive original image without a fringe effect on the continuous fields.

EXAMPLE 10

A tone original with a set of optical densities from 0.15 to 1.50 is reproduced as described in Examples 7 and 8 but with an exposure of 10–15 seconds. As a result, an image is produced within a density interval of 0.15 to 1.2 with adequate tone reproduction and with no fringe effect.

Compared to the existing methods of producing image, the proposed electrophotographic method described in Examples 7 to 10 provides a possibility of multiple reproduction of lined and tone images by means of one-time photography of the original with uniform reproduction of the continuous fields of the image.

EXAMPLE 11

A lined positive original with optical density of 1.45 and a background density of 0.15 is reproduced using a copying apparatus. The selenium plate with a layer about 50 μm thick is charged positively to a potential of 360 V and then exposed during 60 seconds with an aperture of 1:22. The exposed plate is transferred to a room with non-actinic illumination, where a sheet of triacetate film 25 μm thick is applied on the selenium layer in a vacuum frame. After the complete contact with the entire surface of the layer has been achieved, a radioisotope static eliminator is placed above the selenium layer at a distance of 30 mm, the body of the static eliminator being connected with the substrate of the selenium layer. The film on the selenium layer is irradiated by the static eliminator during 5–10 seconds. Then the selenium layer with the film is placed into a medium of gaseous trichlorofluoromethane. The film with a latent image is separated from the layer at non-actinic illumination and the external surface of the film is drenched with a liquid electrophotographic developer during 5–10 seconds. As a result, a positive image of the original is obtained with uniformly developed sections with optical density of the line, D, equal to 2.6–2.8 and a coefficient $\gamma$ of contrast equal to 10.

EXAMPLE 12

The reproduction and development are effected as described in Example 11 but the charge of the selenium plates is taken equal to 500 V. In this case the film is separated from the selenium layer in liquid trifluorotrichlorethylene.

As a result, a positive image of the original is obtained having uniformly developed continuous sections with optical density (D) of the line equal to 2.8–3.0 and a contrast coefficient $\gamma$ equal to 12.

EXAMPLE 13

The reproduction and development are conducted as described in Examples 11 and 12 but the selenium plates are charged to 1000 V. In this case the film is separated from the selenium layer in a gaseous medium using carbon tetrachloride. As a result, a positive image of the original is obtained with uniformly developed continuous sections with optical density D of the line equal to 3 to 3.5 and a contrast coefficient $\gamma$ equal to 15.

Compared to the known methods, the use of the proposed electrophotographic method for producing an image described in Examples 11 to 13 makes it possible to copy originals having poor contrast of the image.

INDUSTRIAL APPLICABILITY

The disclosed electrophotographic method for producing an image on a dielectric film may be used mainly in polygraphy for obtaining line images used as templates when copying a printing plate on a light sensitive material. Furthermore, the method makes it possible to obtain tone and raster images also used in polygraphy and in other areas of copying engineering. The method can be used for obtaining single line and tone images of transparent materials used in cartography, aerial photography, microphotography, etc.

I claim:

1. An electrophotographic method for producing an image on a dielectric film, in which the dielectric film is contacted with the surface of a charged and exposed electrophotographic layer, the latent image on the film is developed and fixed, characterized in that after the dielectic film (3) is contacted with the electrophotographic layer, the dielectric film (3) is acted on by positive and negative ions of the same concentration from a source (4) of ions which settle on the film (3) and produce a latent image thereon; before the development of this latent image the electrophotographic layer is illuminated by an actinic light source (5).

2. An electrophotographic method according to claim 1, characterized in that during and after the illumination of the electrophotographic layer by the actinic light source (5) the dielectric film (3) is separated from the electrophotographic layer for eliminating the fringe effect during the subsequent development of the once-exposed latent image being reproduced.

3. An electrophotographic method for obtaining an image on a dielectric film, in which the dielectric film is contacted with the surface of the charged and exposed electrophotographic layer, the image obtained on the film is developed and fixed, characterized in that after the dielectric film (3) has been contacted with the electrophotographic layer, the dielectric film (3) is acted on by positive and negative ions of the same concentration from the source (4) of ions, which settle on the film (3) and produce a latent image thereon; after that the dielectric layer film (3) is separated from the electrophotographic layer illuminated by a non-actinic light source (8) for eliminating the fringe effect during the development of the multiple-reproduced image.

4. An electrophotographic method according to any of claims 2 or 3, characterized in that the charge of the latent image on the dielectric film (3) is increased by raising the potential of the charge of the electrophotographic layer, the dielectric film (3) being separated from the electrophotographic layer in an electrically inert medium preventing origination of discharge between this film (3) and the electrophotographic layer.

5. An electrophotographic method according to claim 4, characterized in that the electrically inert medium consist of chlorine derivatives of hydrocarbons of the aliphatic series of fluorinechloroderivatives of hydrocarbons of the same series.

* * * * *